United States Patent [19]

Grove et al.

[11] Patent Number: 4,853,106

[45] Date of Patent: Aug. 1, 1989

[54] DELAYED COKING PROCESS

[75] Inventors: J. Jay Grove, Cherry Hill; Grant G. Karsner, Voorhees Township, Camden County, both of N.J.

[73] Assignee: Mobil Oil Corporation, New York, N.Y.

[21] Appl. No.: 87,564

[22] Filed: Aug. 19, 1987

[51] Int. Cl.[4] ..... C10G 9/14

[52] U.S. Cl. ..... 208/131; 208/50; 208/53

[58] Field of Search ..... 208/50, 131, 132, 106

[56] References Cited

U.S. PATENT DOCUMENTS

| | | | |
|---|---|---|---|
| 2,380,713 | 7/1945 | Wilson | 196/58 |
| 3,472,761 | 10/1969 | Cameron | 208/131 |
| 4,036,736 | 7/1977 | Ozaki et al. | 208/106 |
| 4,176,052 | 11/1979 | Bruce et al. | 208/131 |
| 4,302,324 | 11/1981 | Chen et al. | 208/131 |
| 4,334,981 | 6/1982 | Holloway et al. | 208/131 |
| 4,404,092 | 9/1983 | Audeh | 208/131 |
| 4,455,219 | 6/1984 | Jannsen | 208/131 |
| 4,518,486 | 5/1985 | Jansma | 208/131 |
| 4,518,487 | 5/1985 | Graf | 208/131 |
| 4,519,898 | 5/1985 | Allan | 208/131 |
| 4,536,280 | 8/1985 | White, Jr. et al. | 208/106 |
| 4,547,284 | 10/1985 | Sze et al. | 208/131 |
| 4,551,233 | 11/1985 | Blauwhoff et al. | 208/131 |
| 4,661,241 | 4/1987 | Dabkowski | 208/131 |
| 4,673,487 | 6/1987 | Orihashi et al. | 208/132 |
| 4,686,027 | 8/1987 | Bonilla et al. | 208/131 |
| 4,698,313 | 10/1987 | Stewart | 208/131 |

*Primary Examiner*—H. M. S. Sneed
*Assistant Examiner*—Helane Myers
*Attorney, Agent, or Firm*—Alexander J. McKillop; Charles J. Speciale; Malcolm D. Keen

[57] ABSTRACT

Delayed coking process in which improved liquid yield is achieved by varying the rate at which the heavy feedstock is fed to the coke drum. Tandem operation of two active coking drums is disclosed which permits feedrate variation without change of load on furnace.

6 Claims, 2 Drawing Sheets

THIS INVENTION

DELAYED COKING PROCESS

FIELD OF THE INVENTION

This invention relates to a delayed coking process which has an improved liquid yield.

THE PRIOR ART

The delayed coking process has been used in the petroleum refining industry for a considerable time. In this process, the heavy oil feed to the coker, usually the residue from an atmospheric or vacuum crude distillation tower, is heated rapidly in a heater from which it flows directly to an insulated drum where the coking or carbonizing reactions take place. Coking takes place in the carbonizing mass in the lower portion of the coker drum during the delayed residence of the heated feed in the drum, usually for a period of about eighteen hours to twenty four hours. At the start of the coking reaction the drum is empty and it is gradually filled during the course of the coking reaction until the mass of coke approaches the top of the drum. The coking reaction takes place at temperatures of about 450° to 500° C. and under mildly elevated pressures, typically 100 to 1000 kPa. The temperature, pressure and other conditions are generally adjusted to produce the least amount of coke consistent with smooth operation and design capacity. At the end of the coking reaction, the coke which is left behind in the drum is removed while the feed from the heater is switched to another drum.

The object of the coking process is to upgrade the residual feedstock and so to obtain relatively lighter liquid products of greater value which are generally used as feedstock for catalytic cracking units, e.g. a fluid catalytic cracker (FCC). To ensure that the liquid product from the coker is of suitable quality, the product from the coker is usually fractionated and the bottoms fraction, typically boiling above 370° C., is recycled. The recycle stream generally constitutes about 5 to 25 vol% of the fresh feed.

Various proposals have been made to alter the product distribution and therefore improve the economic value of the products from delayed coking. This is not surprising in view of the reported capacity (as of 1985) of over 62,000 tons of coke per day in the United States alone. U.S. Pat. No. 4,455,219 to Janssen et al. proposes to substitute a lower boiling range material for part of the conventional recycle to reduce coke make. U.S. Pat. No. 4,518,487 to Graf et al. is concerned with a similar concept. U.S. Pat. No. 4,661,241 to Dabkowski et al. discloses improved liquid yield and liquid product distribution by operation in the absence of heavy recycle. U.S. Pat. No. 4,404,092 to Audeh et al. discloses improved liquid product yield with reduced gas yield by quenching cracked vapors. U.S. Pat. Nos. 4,661,241, 4,404,092 and the present application have a common assignee, and the contents of these patents are incorporated herein by reference.

The coking reaction is principally a thermal cracking reaction which takes place at the relatively high temperatures prevailing in the coker drum. The cracking reactions do not, however, cease when the heavy residual feedstock has been converted to coke and lighter liquid products; because the same high temperatures prevail in the vapor space above the carbonizing mass in the drum, the vaporized liquid product tends to be cracked further and non-selectively to form even lighter $C_4$- products, including gas, resulting in an undesirable loss in liquid yield. Accordingly, it would be desirable to minimize the $C_4$- gas yield so as to obtain a greater quantity of liquid products for the processing units fed by the coker.

It is an object of this invention to provide an improved delayed coking process wherein the yield of liquid products is increased with decreased yield of lower-valued gaseous products including $C_4$ and lighter gases. It is a further object of this invention to provide a delayed coking process wherein the yield of liquid products is increased and the cycle time is decreased. These and other objects will become evident on reading this entire specification including the appended claims.

BRIEF DESCRIPTION OF THE DRAWING

FIG. 2(*b*). Another embodiment using two furnaces.

SUMMARY OF THE INVENTION

Figure 1:
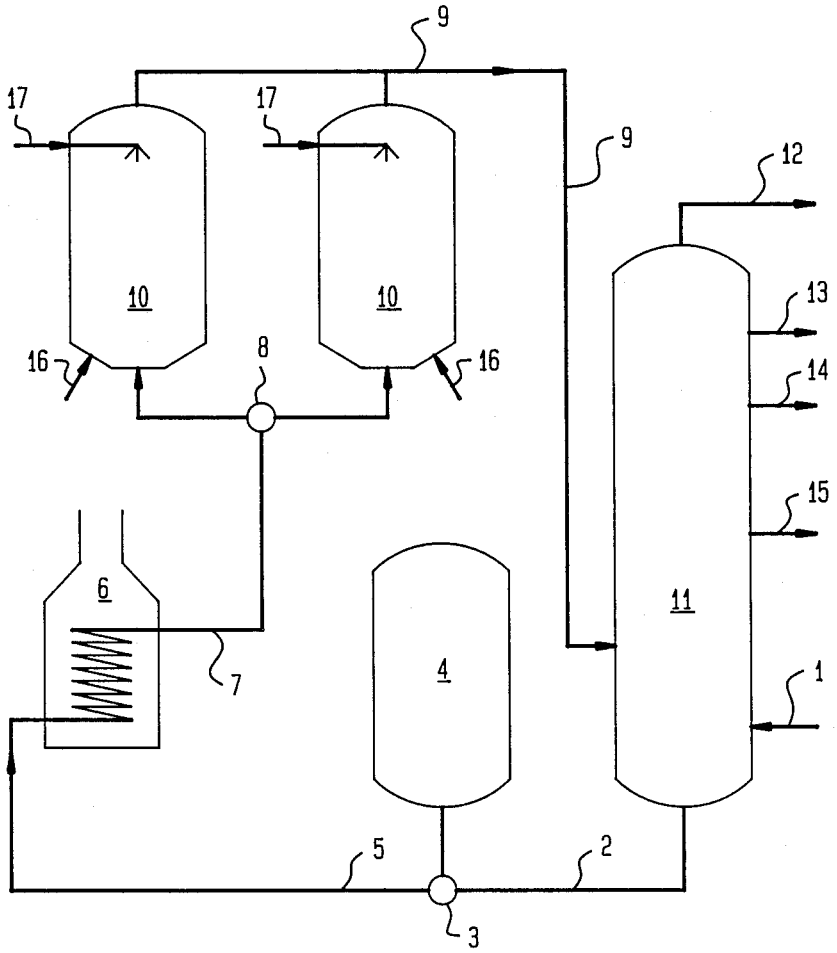
FIG. 1. Illustrates one embodiment of the invention.

According to the present concept, the conventional delayed coking process is modified by controlling the flow rate of the feedstock so as to reduce the real residence time of cracked products during the early portion of the coking cycle and increasing the real residence during the later portion of the coking cycle, all as more fully described hereinbelow. In one embodiment of this invention, the total cycle time is reduced, increasing the capacity of the coker. In another embodiment, a water quench is injected into the drum during the later portion of the coking cycle to controllably reduce the vapor temperature and further increase the liquid products yield, as described hereinbelow.

DETAILED DESCRIPTION AND PREFERRED EMBODIMENTS

The vapor residence time in a coke drum is to a close first approximation inversely proportional to feed rate, but it is also affected by product vapor density, (which is related to operating temperature and pressure), by steam rate, and by available drum volume.

In normal operation, the feedstock, after passage through the coker furnace, is introduced at a predetermined fixed flow rate of V $ft^3$/hr into an initially empty coker drum having a known volume and capable of containing the coke formed from C $ft^3$ of feedstock. The term "processing capacity of C $ft^3$" as used herein means that the empty drum will contain the volume of coke formed from C $ft^3$ of a particular feedstock under a conventional set of coking conditions. C $ft^3$ is normally much larger than the volume of the empty drum, and may vary with different feedstocks depending principally on the coke yield.

It is evident to one skilled in the art that with a fixed rate of feed the real residence time of the vapors in the empty or near-empty drum is twice as long as it is in a half-filled coke drum, and four times as long as in a three-quarter filled drum, i.e. that there is a wide divergence of real residence times as the coking portion of the cycle progresses.

This concept invention requires that the empty coke drum initially be filled at a relatively fast rate compared with the average rate. The net effect of this operation is to reduce the residence time of the cracked vapors over the portion of the drum-filling operation during which the real residence time of the vapors is the longest. After a predetermined fill level has been reached, the flow rate of the feedstock is substantially reduced for the remainder of the fill. Since the rate of formation of cracked products is to a first approximation proportional to the feed rate, the net result of the reduced feed rate is to increase the real residence time of the cracked products to greater than what it would be at the same drum fill volume at the average feed rate. In brief, the overall effect, for example with two different feed rates as compared with the average feed rate, is to bring the residence time at various incremental levels of filling closer to the average than theY might otherwise be if filled at the average feed rate. This is advantageous since it minimizes the inordinately high formation of gaseous products during the initial fill of the drum. This invention will be better understood by reference to the drawing.

The delayed coking process of the present invention may suitably be carried out in a coking unit of the type shown in FIG. 1. In this unit, two coker drums 10 are provided in order to permit continuous operation with coking taking place alternately in each drum. A greater number of drums may of course be used in order to provide the desired coking capacity. The drums will be equipped with the usual means for removing the coke which, being conventional, are not shown in the diagram. A feed line 1 connected to a source of heavy hydrocarbon coker feed passes to product fractionator 11 where it combines with heavy recycle to form the heavy hydrocarbon oil feedstock for the coking operation. This heavy hydrocarbon oil feedstock passes from fractionator 11 via line 2 and then through a multiport valve 3 which controls diversion of a fraction of the feed from line 2 to a surge tank 4 with the remainder of the feedstock passing through line 5 to furnace 6, thus effecting reduction of the rate of feed in line 5 compared with line 2. Alternatively, multiport valve 3 is adjusted to pass all of the flow from line 2 to line 5 along with additional feedstock from surge tank 4, thus effecting an increase in the rate of feed in line 5 compared with line 2. In furnace 6 the feed is heated to the desired temperature for the coking process, and passes via line 7 to a switch valve 8 which permits the heated feed to flow to one drum or the other, depending upon which is currently being filled. The coker drums 10 are connected to common overhead line 9 which passes to fractionator 11. The gaseous overhead products leave the fractionator by line 12, and other products such as light hydrocarbons ($C_3$–$C_4$) from line 13 and gasoline from line 14. These products may be passed to subsequent processing units such as a hydrodesulfurizer. The heavy gas oil product passes out through line 15 to be passed to the cracking unit. The bottoms fraction of the tower combined with fresh feed is passed from the tower via line 2. Steam strippers 16 are provided in the conventional manner. Other conventional equipment such as separator drums are omitted from the diagram for clarity.

In operation, the coker feedstock mixed with steam is heated in furnace 6 to a suitable temperature for the coking reaction to proceed, generally above 450° C. and typically in the range of 450° C. to 500° C. The heated feed then proceeds to the bottom of one or the other of the coker drums which, at the start of the coking cycle, is empty. As the heated feedstock is fed into the bottom of the drum, the coking reaction proceeds and the level of the carbonizing mass in the drum rises. The feedstock is coked under the conditions prevailing in the drum, to produce the desired cracking products together with some gas and the coke, which remain behind in the drum. During this time, the gases and vapors produced by the Coking reaction leave the coking drum by the overhead line and pass to the fractionator for separation in the normal way. The coking cycle is continued until the coke level reaches the top of the coker, at which time the cycle is then terminated, with the feed being transferred to the swing drum.

Optionally, drums 10 may be provided with spray heads 17 in order to reduce the vapor temperature in a controllable manner, as described in U.S. Pat. No. 4,404,092, such as by the injection of water or steam. Water is an effective quenching liquid because of its high heat of vaporization and a high specific volume so that in effect it further reduces the reactive vapor space available for the undesirable cracking reactions. Thus, because of the reduced partial pressure of the organic vapors, the liquid coking products will have a reduced residence time in the vapor space of the coker, further inhibiting the tendency for secondary cracking to occur and increasing liquid yield. However, if steam is readily available it may be used as an alternative to water even though it has the disadvantage relative to water of not cooling by evaporation. When water or steam are used, a steam knock-out drum may be interposed between the coker and the fractionator to remove the steam at this point.

Figure 2A:
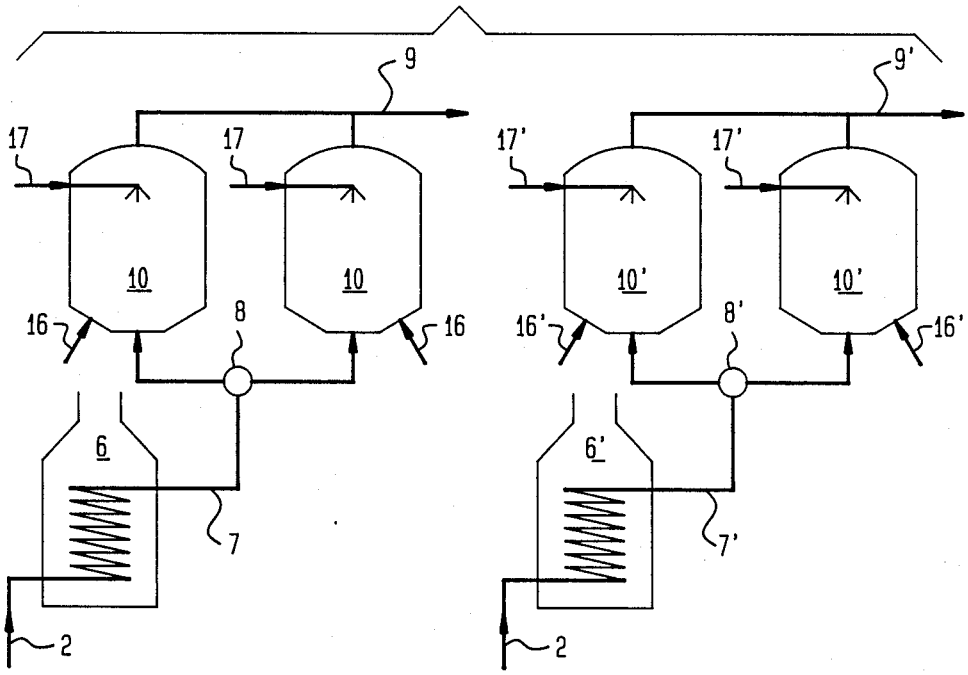
FIG. 2a (PRIOR ART)
FIG. 2(*a*). Prior Art.
Figure 2B:
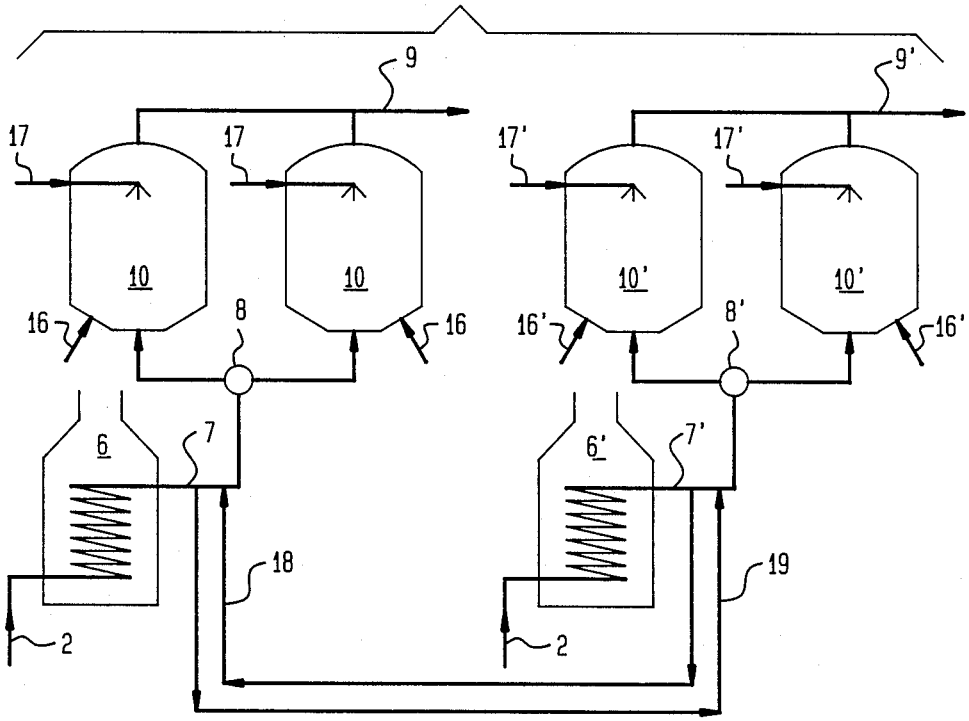

FIG. 2 of the drawing illustrates a preferred embodiment of this invention, in which the feeds to four drums serviced to two furnaces are coupled as shown. This arrangement obviates the need for surge tank 4 or equivalent storage means and allows wide latitude for adjustment of flow rate during the coking cycle. All common indicia in FIG. 1 and FIG. 2 are are for the same elements described above, noting in FIG. 1 that the feed to furnace 6 in FIG. 2 is taken directly from line 2 from the fractionator. The indicia for the second coker unit are shown as primed numbers.

In one possible operation, for example with a 20 hour drum fill time, at 10 hours drum 10 is empty and active drum 10' is filled to 75 percent of capacity. At this point and for the next ten hours one-half of the flow from furnace 6' passes via 7' and valve 8' to complete the fill of active drum 10', the remainder being passed via line 18 to active drum 10. At 20 hours, the flow in line 18 is stopped and one-half of the flow from furnace 6 is passed via line 19 to begin the fill of empty drum 10', the remainder passing via line 7 and valve 8 to complete the fill of active drum 10. Valving for lines 18 and 19 are omitted for clarity. It is evident, for this embodiment as well as that described for FIG. 1, that many combinations of two or more feed rates may be used such that the average feed rate remains unchanged, with the effect that the real residence time of the cracked vapor products during the early portion of the drum-fill cycle is reduced, necessarily effecting a decrease in the variation of residence time of the cracked vapors compared with the variation that obtains at a conventional, fixed, average drum-fill rate.

One advantage of the present invention is that it may be implemented with little or no change in existing equipment. For example, in an installation that already has provision for temporary storage of hot fresh feed, no changes may be needed to permit practice of the present invention in the embodiments shown in FIG. 1 of the drawing. Practice of the invention according to the preferred embodiment illustrated in FIG. 2(*b*) of the drawing requires nothing more than installation of piping and suitable valves. It is also contemplated that in some instances the use of the method of this invention may permit somewhat shorter drum-fill time than would obtain with conventional operation.

Another advantage of the invention herein provided is that it may be readily and advantageously combined with other known methods for favorably altering the product distribution in delayed coking. For example, U.S. Pat. No. 4,404,092 provides for controlling the temperature of the vapor space above the carbonizing mass so that the incipient coking and cracking of the vapors is reduced. This is accomplished preferably by the injection of liquid water which, aside from its temperature control function, also serves to reduce the partial pressure of the hydrocarbon vapors and to reduce the residence time. When the present invention is combined with water injection, the combination is most advantageously practiced by reserving the water injection for the last half of the drum-fill cycle, whereby reducing the relatively long residence times associated with this portion of the drum-fill operation, and also effecting a reduction of the overall average residence time. The present invention is also advantageously combined with the modification described in U.S. Pat. No. 4,661,241 whereby further improving the liquid yield and selectivity (reduction of coke yield) by adding to the fresh feed a hydrocarbon oil having an end distillation point below 450° C. to supplant part or all of the heavy recycle.

Another advantage of the present invention accrues with a plant which, in normal operation, is limited in throughput by the $C_4$- gases. In such instances, with the use of the present invention, the throughput of the plant may be moderately increased, for example by up to 10 percent or even up to 20 percent.

The following examples are intended to illustrate the present invention without limiting the scope thereof. Said scope is determined by this entire specification, including the appended claims. All proportions given are by weight unless explicitely stated to be otherwise.

EXAMPLES 1-5

Five pilot runs, each at a different but fixed feedrate, were conducted with a furnace feed having the properties shown in Table I to determine the effect of residence time on coker yields. Pressure and drum vapor temperature were nominally maintained at 75 psig and 830° F., respectively, for each run. For purposes of comparison, the vapor residence time was defined for an empty drum case and was varied between four and seven minutes by selecting the feedrate. Although residence time decreases as the drum is filled, the average residence time over the course of the coking cycle remains inversely proportional to feedrate. Therefore, the empty drum (initial) residence time was used as a basis for characterizing reaction severity. The results for the five individual runs are summarized in Table II. The average of the $C_4$- make for Examples 1 and 2 was 9.0% at an average residence time of 4.35 minutes, while the average $C_4$- make for Examples 3-5 was 10.6% for an average residence time of 6.6 minutes.

TABLE I

| Furnace Feed Properties | |
|---|---|
| Density, 70° C. | 0.995 |
| % H (NMR) | 10.59 |
| CCR | 16.08 |

TABLE I-continued

| Furnace Feed Properties | |
|---|---|
| Pentane Insolubles | 13.05 |
| % N | 1.24 |
| % S | 1.57 |
| KV, 100° C. | 753.6 |
| ppm Ni | 130 |
| ppm V | 125 |
| Boiling Range Distribution | |
| IBP | 477 |
| 5 | 720 |
| 10 | 820 |
| 20 | 928 |
| 30 | 1007 |
| 40 | 1067 |

TABLE II

| Example | Residence Time, (Min)(1) | Yields (wt %) Coke | $C_4$— | $C_5$-400 | 400-640 | 650+ |
|---|---|---|---|---|---|---|
| 1 | 4.0 | 33.2 | 8.4 | 16.1 | 23.7 | 18.6 |
| 2 | 4.7 | 32.1 | 9.6 | 16.5 | 23.5 | 18.3 |
| 3 | 6.2 | 33.7 | 11.4 | 18.9 | 21.8 | 14.2 |
| 4 | 6.7 | 33.1 | 9.7 | 17.0 | 23.7 | 16.5 |
| 5 | 6.9 | 33.7 | 10.6 | 18.5 | 23.4 | 13.8 |

(1)Based on empty drum

What is claimed is:

1. A process for the delayed coking of a heavy hydrocarbon oil feedstock in an apparatus comprising a first and second coker furnace and a first and second active coking drum, each of said coking drums having a processing capacity for C $ft^3$ of heavy hydrocarbon oil feedstock preheated to coking temperature by said furnaces, each of said furnaces being capable of providing a continuous flow of said preheated feedstock at a fixed flow rate of V $ft^3$/hr such that at a total drum-fill time of t hours each provides a flow $(V \times t) = C$, which process comprises:

(a) providing conduit and valve means whereby the combined output of said first and second furnace is unequally proportioned between said first and second active coking drums;

(b) initiating the fill of said first active coking drum at flow rate $V_1$ which is greater than V but less then 2V and maintaining said flow for 0.5 t hours while passing the remainder of said combined output to said second active coking drum whereby completing its fill; and, (c) completing the fill of said first active coking drum at a flow rate of $V_2 = 2V - V_1$ while initiating the fill of said second active coking drum at flow rate $V_1$.

2. The process described in claim 1 wherein $V_1$ is about 1.1 V to about 1.8 V.

3. The process described in claim 2 wherein $V_1$ is about 1.1 V to about 1.5 V.

4. The process described in claim 1 and including the step of introducing a quenching liquid into the vapor space of the coker drum in the region of the outlet, whereby the temperature of vapor space is maintained at its lowest in the region of the outlet and at its highest in the region of the interface with the carbonizing mass.

5. The process described in claim 4 wherein the quenching liquid is water and said vapor space temperature is about 425° C.

6. The process described in claim 1 and wherein said heavy hydrocarbon oil feedstock includes up to about 20 wt % of a hydrocarbon oil having an end boiling point of not more than 450° C.

* * * * *